US005411242A

United States Patent [19]

Lonardi et al.

[11] Patent Number: 5,411,242

[45] Date of Patent: May 2, 1995

[54] CHARGING DEVICE WITH MEMBER FOR REGULATING THE FLOW RATE

[75] Inventors: Emile Lonardi, Bascharage; Gilbert Bernard, Helmdange; Giovanni Cimenti, Fentange; Jean-Jacques Venturini, Obercorn, all of Luxembourg

[73] Assignee: Paul Wurth S.A., Luxembourg

[21] Appl. No.: 205,524

[22] Filed: Mar. 3, 1994

[30] Foreign Application Priority Data

Mar. 4, 1993 [LU] Luxembourg ..... 88 231

[51] Int. Cl.[6] ..... C21B 7/18

[52] U.S. Cl. ..... 266/184; 266/199

[58] Field of Search ..... 266/184, 199, 44; 222/537, 549

[56] References Cited

U.S. PATENT DOCUMENTS 3,554,393 1/1971 Barballe et al. ..... 266/184
3,799,369 3/1974 Mahr ..... 266/184

FOREIGN PATENT DOCUMENTS 0088253 9/1983 European Pat. Off. .
0062770 8/1985 European Pat. Off. .
2202641 4/1973 Germany ..... 266/184
3934997 5/1990 Germany .
2226621 7/1990 Germany .

*Primary Examiner*—Scott Kastler
*Attorney, Agent, or Firm*—Fishman, Dionne & Cantor

[57] ABSTRACT

A charging device is provided for feeding an enclosure with a predetermined flow rate of a solid material. The device comprises a materials hopper, a pipe for feeding the enclosure, and a member for retaining and for regulating the flow rate of material. The member for retaining and for regulating the flow rate of material comprises a bell for closing off a discharge opening, and a central metering body which is oblong and distinctly more slender than the bell. The bell and the central metering body can be moved relative to one another so that the distance which separates the two of them can be freely adjusted.

8 Claims, 6 Drawing Sheets

100
28
30
94
96
90
92
86
88
36
38
32
24
84
26
82
34
40
42
22
20
44
46
80
64
78
66
18
60
76
74
72
70
48
62
54
52
58
68
56
50
52
14
12
10

CHARGING DEVICE WITH MEMBER FOR REGULATING THE FLOW RATE

BACKGROUND OF THE INVENTION

This invention relates generally to a charging device feeding an enclosure and/or blast furnace or the like. More particularly, this invention relates to a charging device for feeding or delivering to an enclosure or blast furnace with a predetermined flow rate of a solid material.

Devices of this sort are used, for example, in blast furnaces, more specifically in blast furnaces which are equipped with a tilting and/or rotary distribution chute. The hopper then constitutes a receptacle for vertically sealing off the charging material and furthermore includes a lower sealing member which makes it possible to isolate the hopper with respect to the pressurized furnace.

Such a device, which is designed to equip a blast furnace furnished with a rotary or tilting distribution chute, is known from Patent document U.S. Pat. No. 4,514,129. There is disclosed, in this document, a combined member for retaining and for regulating the flow rate of material, which comprises two registers in the form of spherical or cylindrical caps. The relative motion of these two caps makes it possible to vary the passage section symmetrically about the central outflow axis of the material. These registers are set out in a leaktight chamber, situated directly below the hopper. This leaktight chamber is equipped at its lower end with the lower sealing member. The lower sealing chamber comprises a shutter which can be pivoted between a lateral position, in which it is sheltered from the material discharged from the hopper, and a closing off position, in which it is transverse to the outflow axis of the material. In this closing off position, the shutter can be applied, through an axial transnational motion, onto a seat. This seat peripherally surrounds the discharge opening of the hopper, and is equipped with a sealing surface pointing downwardly, that is to say in the direction of outflow of the material.

A device of the sort described in Patent document U.S. Pat. No. 4,514,129, is capable of giving complete satisfaction from the point of view of regulating the flow rate and from the point of view of settling, even for an enclosure in which high working pressures prevail. Its only drawback is its high assembly height, which results from the fact that the combined member for retaining and for regulating the flow rate of material and the sealing member are superimposed below the hopper. To overcome this drawback, if required, it would, for example, be possible to envisage replacing the member for regulating the flow rate located below the hopper by a member for regulating the flow rate incorporated directly into the hopper.

From Patent document U.S. Pat. No. 4,512,702, a device is known for charging a blast furnace, of the sort described hereinabove, which is equipped with a combined member for retaining and for regulating the flow rate Of material. This device comprises a bell which is incorporated into the materials hopper. This bell, which has the form of an axisymmetric cone flaring out in the direction of its lower edge, can be moved vertically along the axis of the hopper. In the lowered position, it interacts with a first seat set out at the level of the discharge opening of the hopper in order to close the above mentioned hopper off. In the raised position, it defines an annular outflow opening between the funnel-shaped wall of the hopper and its lower edge. The passage section of this annular opening depends on the vertical travel of the bell. Now, it is well known that with a bell of this sort, there is no guarantee of satisfactory regulation of the flow rate of material. In order to alleviate this drawback, Patent document U.S. Pat. No. 4,512,702 proposes equipping the bell, on the side of its lower edge, with an oblong and pointed body which is coaxial with the central axis of the discharge opening and which extends axially through the discharge opening in the direction of the pipe for feeding the chute. The profile of this body should then theoretically make it possible to determine the regulation characteristic, that is to say the function "flow rate of material/vertical travel of the retaining and regulating member". The result obtained is, however, rather disappointing.

Patent document EP-A-0 088 253 also proposes a lower sealing member which is incorporated into the hopper. This sealing member comprises a closing off disc, which is set out below the bell and equipped with a peripheral seal on the side of its lower face. When the bell bears on its seat, the disc may be applied axially to a second seat. The second seat, which is situated below the first seat, has a passage section which is smaller than the first seat and is equipped with a sealing surface pointing towards the inside of the hopper. This leaktight member does not, however, give satisfaction. Indeed, this second seat, which is exposed to wear by the materials flowing out through the discharge opening, is rapidly deteriorated and is therefore no longer capable of ensuring closure which is leaktight with respect to the pressurized gases.

Now, on the other hand, if it is desired, in the charging device of Patent document U.S. Pat. No. 4,512,702, to replace the lower sealing member incorporated into the hopper, by a pivotable sealing shutter, of the type which is known from Patent document U.S. Pat. No. 4,514,129, any advantage from the assembly height point of view is lost. Indeed, when the bell is bearing on its seat, the above mentioned oblong and pointed body is necessarily situated below the discharge opening of the hopper. Since the pivotable sealing shutter cannot pass through the oblong body, it is consequently necessary to provide, below the materials hopper, a leaktight chamber into which this oblong body can penetrate with its entire length. The sealing shutter will then be incorporated into the lower end of this leaktight chamber, the height of which is certainly not less than the height of the leaktight chamber enclosing the above mentioned registers in the form of spherical caps which are known from Patent document U.S. Pat. No. 4,514,129.

It is obvious that there is a need to provide a charging device in which the member for retaining and for regulating the flow rate of materials is incorporated into the hopper, but which does not have all the disadvantages mentioned hereinabove for the device of Patent document U.S. Pat. No. 4,512,702.

SUMMARY OF THE INVENTION

The above-discussed and other problems and deficiencies of the prior art are overcome or alleviated by the charging device with member for regulating the flow rate of the present invention. In accordance with the present invention, a charging device with member for regulating the flow rate is provided which comprises a hopper including a funnel-shaped lower part which defines a substantially vertical central outflow axis, a pipe for feeding the enclosure, which is situated axially below the lower part of the hopper; and a member for retaining and for regulating the flow rate of material, which includes a bell, which is movable inside the hopper between a lower position for closing off a discharge opening in the lower part of the hopper and an upper raised position, and a central metering body, which is oblong and distinctly more slender than the bell, coaxial with the central outflow axis and movable along the central outflow axis so as to penetrate to a greater or lesser degree through the aforementioned discharge opening in the direction of the feed pipe. The bell and the central metering body are movable relative to one another, so that the vertical distance which separates the two of them can be freely adjusted. It should be noted that the term "bell" also encompasses a retaining body which does not necessarily have the form of a bell.

In the device in accordance with this invention, the central metering body is no longer a constituent element of the bell, but an independent element, the position of which with respect to the discharge opening may be adjusted independently with respect to the position of the bell in the materials hopper. This feature makes it possible to place the bell at a distance from the discharge opening, where this bell practically no longer affects the flow rate flowing out through this discharge opening. This flow rate may therefore be regulated essentially by the movement of the central metering body. It then follows that the regulation characteristic, that is to say the function $Q=f(C)$, in which Q is the flow rate of material flowing out through the discharge opening and C is the travel of the central metering body, may be determined by the choice of longitudinal profile of the oblong and slender body. This enables the oblong and slender body to now satisfactorily fulfil its role of central metering body. It is thus, for example, possible to obtain a linear characteristic $Q=k(C)$, in which k is a constant depending on the nature and on the grain size of the charging material.

It will be noted that if it were desired to obtain similar results using the device of Patent document EP-A-0 088 253, it would be necessary to give the central metering body an excessive length. For a hopper the funnel-shaped part of which has a vertex angle of 80°, this length would for example, be greater than twice the diameter of the discharge opening.

Another advantage of the device of the present invention lies in the fact that the position of the bell in the hopper may be varied freely upstream of the position in which it practically no longer influences the flow rate flowing out through the discharge opening. This possibility of being able to vary the location of the bell in the hopper, without in any way acting on the flow rate, makes it possible to choose a location for the bell in the hopper in which the bell optimally influences the homogeneity of the outflow of the material inside the hopper. It is thus possible to reduce the phenomenon of the solid particles segregating depending on their grain size. This well known phenomenon originates in the fact that the finer particles tend to flow out through the center of the hopper, whereas the coarser particles tend to flow out along the walls. By an optimal location of the bell in the material, which location is chosen and adjusted as a function of the nature and of the grain size of the charging material, as well as of the filling height of the hopper, it is possible to bring about a more homogeneous emptying of the materials hopper. It is possible, for example, to adjust the location of the bell as a function of the charging height continuously as a function of an output signal from a device for weighing the hopper.

In a preferred embodiment, the central metering body comprises a lower frustum, which flares out firstly upwards and which terminates in an upper end which tapers in the direction of a control rod. The lower frustum acts as a regulating element. The other end of the regulating element is designed to influence the outflow of material as little as possible.

Preferably, the bell is equipped with a hollow back or cavity into which the central metering body can be entirely drawn, for example when the bell is in its lower position for closing off the outflow opening. It then follows that in the position for closing off the discharge opening, there is no longer any element which penetrates through the discharge opening.

Equipped with a lower sealing member, the device may be installed on a pressurized enclosure, for example a blast furnace. The hopper then acts as a receptacle for vertically sealing off the solid material to be charged into the pressurized receptacle.

In a first embodiment, such a lower sealing member comprises a shutter which can be pivoted between a lateral position, in which it is sheltered from the material discharged from the hopper, and a closing off position in which it is transverse to the outflow axis of the material, and in which it can be applied axially onto a seat. The seat peripherally surrounds the discharge opening of the hopper and is equipped with a sealing surface pointing downwards. It will be noted that this sealing member is in no way exposed to wear from the materials flowing out from the discharge opening of the materials hopper. When the central metering body can be entirely drawn back into the bell, the sealing shutter may, moreover, be mounted directly downstream of the discharge opening. This makes it possible to achieve an appreciable saving in assembly height by comparison with the device known from Patent document EP-A-0 062 770.

It is, however, also possible to equip the proposed device with a lower sealing member comprising: a closing off element set out directly below the bell and capable of being moved axially with respect to the bell, the closing off element being equipped with a lateral peripheral surface in which is incorporated an inflatable seal and with a central passage opening for the central metering body; means for moving the closing off element axially between a protected position below the bell and an operational position outside the bell, when the bell is in the lower closing off position; and a seat mounted axially below the discharge opening, the seat being equipped with a first sealing surface which points downwards and which surrounds the inflatable seal when the closing off element is situated in the operational position. This lower sealing member makes it possible to reduce the assembly height of the charging device still further. Indeed, it is no longer necessary to provide a chamber enclosing a leaktight shutter between the discharge opening of the hopper and the pipe for feeding the pressurized enclosure. By comparison with the device from Patent document EP-A-0 062 770, this preferred embodiment of the device makes it possible, above and beyond the advantages obtained from the point of view of regulation, to avoid too rapid wear of the sealing seat. This is consequently a preferred embodiment which has excellent qualities from the point of view of regulation and resistance to wear of the lower sealing member, as well as a minimum assembly height.

In a first embodiment, the bell is equipped with an upper sleeve which is extended axially upwards through the hopper. This sleeve makes it possible to introduce and extract the central metering body through this sleeve and at the same time constitutes an axial guide for the central metering body. At least a first hydraulic cylinder situated outside the materials hopper is connected between the materials hopper and the sleeve. This or these first hydraulic cylinder(s) is (are) dimensioned to provide the force necessary for raising the bell through the material. The central metering body is equipped with a coaxial rod which is guided axially inside the sleeve, and at least a second hydraulic cylinder is connected axially between the sleeve and this rod. This second hydraulic cylinder is slaved to the first hydraulic cylinder(s) so that a travel (c) of the bell in a first direction simultaneously brings about a travel (c) of the central metering body in the opposite direction.

In a second embodiment, the hopper is equipped with a fixed guide sleeve which extends axially downwards inside the hopper. The bell is equipped with an upper sleeve which can be engaged on this fixed sleeve. The central metering body is equipped with a coaxial rod which is axially guided inside the fixed sleeve. At least a first hydraulic cylinder is connected between the hopper and the upper sleeve, and at least a second hydraulic cylinder is connected between the hopper and the rod inside the fixed sleeve.

The above-discussed and other features and advantages of the present invention will be appreciated and understood by those of ordinary skill in the art from the following detailed discussion and drawings.

BRIEF DESCRIPTION OF THE DRAWINGS

Referring to the drawings, wherein like elements are numbered alike in the several Figures.

DESCRIPTION OF THE PREFERRED EMBODIMENTS

Figure 1:
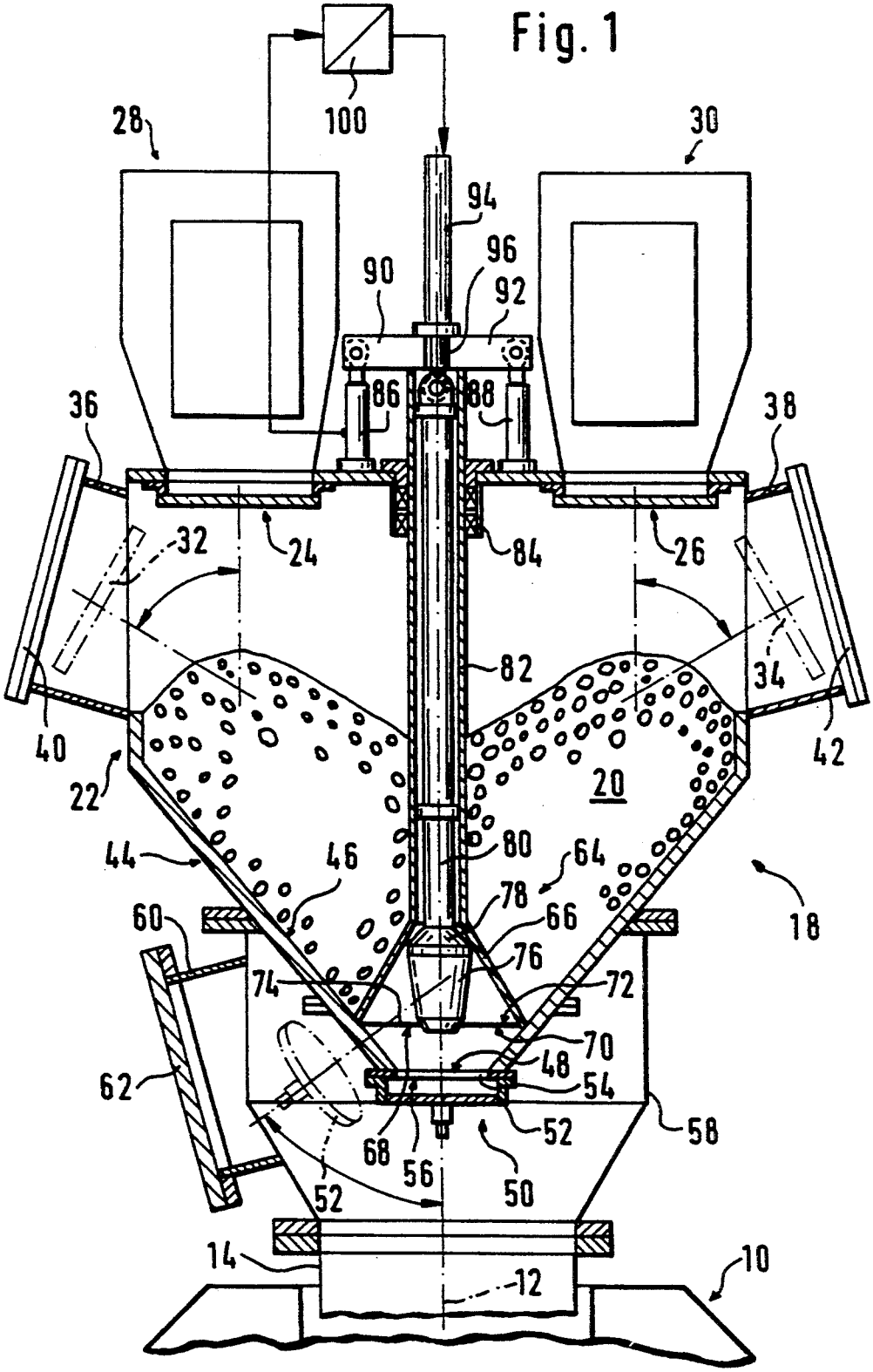
FIG. 1 is a diagrammatical elevation (vertical) sectional view of a charging device for a blast furnace in accordance with the present invention.

Referring first to FIG. 1, a first embodiment of the charging device with member for regulating the flow rate is shown generally in diagramatical cross-section by the entire FIG. 1.

The reference 10 denotes a casing of a mechanism for driving a rotary or tilting distribution chute (not represented). The reference 12 denotes the vertical axis of the blast furnace. A feed pipe 14 passes axially through the casing 10 to feed the distribution chute with charging material, for example coke, sinter, pellets, etc. This feed pipe 14 is coaxial with the vertical axis 12 of the blast furnace.

The reference 18 denotes, globally, a hopper which constitutes a receptacle for sealing off the charging material from the blast furnace. This charging material is denoted inside the hopper 18 by the reference 20. The hopper 18 comprises an upper part 22 having the form of a cylinder coaxial with the vertical axis 12. Two charging openings 24 and 26 via which the hopper may be filled are set out in this upper part 22. Filling takes place for example, in a way known per se, through the use of two conveyors with skips 28 and 30.

Each of these charging openings 24 and 26 is equipped with an upper sealing shutter 32 and 34. These upper sealing shutters guarantee, in the closed position, sealing of the hopper with respect to the outside atmosphere. In FIG. 1 they are represented, in broken line, in the open position. It is noticed that, in this position, they are each situated in a lateral pipe 36, 38 of the hopper, well sheltered from the material discharged by the skips 28, 30 through the charging openings 24 and 26. Each of these pipes 36, 38 is provided with a removable closing off plate 40, 42 which allows access to the respective shutter for maintenance work.

The upper part 22 of the hopper 18 is extended into a lower part 44 which has the form of a funnel or of an axisymmetric cone frustum coaxial with the axis 12. The vertex angle of the axisymmetric cone lies, for example, between 60° and 80°, which corresponds to a slope of an internal wall 46 of the order of 50° to 60°.

A lower opening 48, coaxial with the axis 12, is equipped with a sealing member 50. The sealing member 50 ensures, in the closed position, sealing of the hopper 18 with respect to the blast furnace.

In the embodiment represented in FIGS. 1 to 5, the sealing member 50 comprises a sealing shutter 52 which can be pivoted from a lateral position (represented in broken line in FIGS. 1 and 2), in which it is sheltered from the material flowing out from the opening 48, into a closing off position in which it is transverse to the axis 12. In this closing off position, the shutter 52 may be applied, in a way known per se, axially onto a seat 54 peripherally surrounding the opening 48 and equipped with a sealing surface 56 which points downwards. The space necessary for the pivoting of the shutter 52 below the hopper 18 is obtained by connecting the hopper 18, with the aid of a leaktight chamber 58, to the feed pipe 14. A lateral pipe 60, equipped with a removable closing off plate 62, makes it possible to have access to the inside of the leaktight chamber 58 for replacing the shutter 52 or the seat 54.

The reference 64 denotes generally the member for retaining and for regulating the material. This member includes a bell 66 and a central metering body 68 which can be moved with respect to one another along the axis 12.

Figure 2:
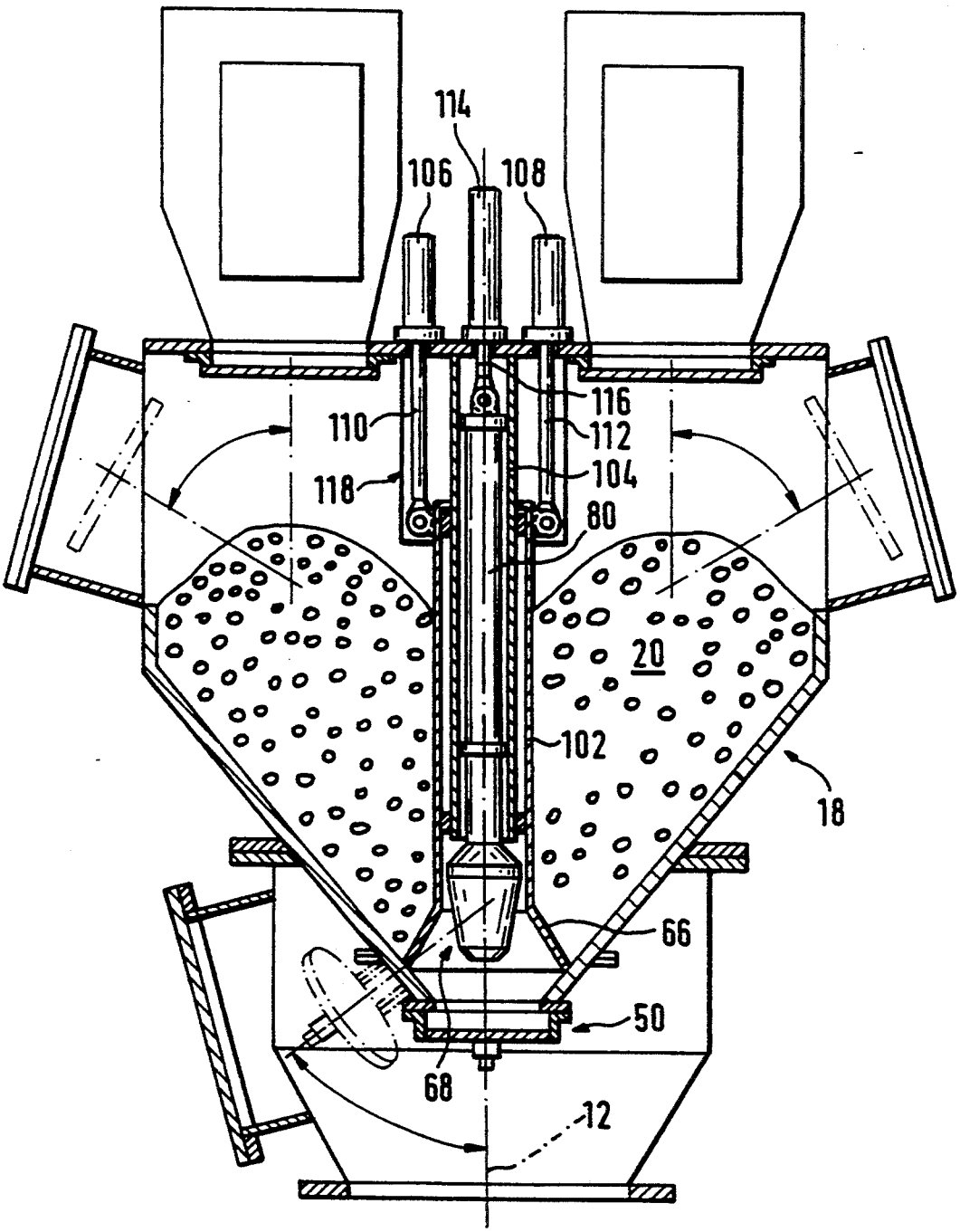
FIG. 2 is a first preferred embodiment, shown in diagrammatic elevation (vertical) view of the device of FIG. 1.

The bell 66 has the form of a hollow cone frustum which is coaxial with the axis 12 and which flares out in the direction of a lower horizontal edge 70. In FIGS. 1 and 2, the bell is represented in a closing off position. It bears with its lower edge 70 on the inner wall 46 of the hopper 18, so as to close off a passage section 72 in the conic part of the hopper 18 upstream of the sealing member 50. In other words, this passage section constitutes a discharge opening 72 of the hopper 18, which can be closed off by the bell 66 and which can be cleared by drawing the bell 66 back upwards.

The central metering body 68 has an oblong shape, substantially more slender than the bell 66. This is, for example, an axisymmetric body composed of two superimposed cone frustums 74, 76 which flare out upwards and which define the regulating profile proper. At its upper end 78, this axisymmetric body tapers progressively in the direction of a support rod 80 which is coaxial with the axis 12. The choice of the profile of the central metering body 68 is determined, either experimentally, or by calculation. What is important is that the central metering body 68 is oblong and above all distinctly more slender than the bell 66. With the profile represented in the figures good linearity of the regulation characteristic Q=f (C) has been obtained for conventional charging materials for a blast furnace. It will be noted that the vertex angle of the cone frustum 76 is slightly less than the vertex angle of the hopper; that the vertex angle of the cone frustum 74 is substantially equal to the vertex angle of the hopper; and that the cumulative height of the two cone frustums 74, 76 is substantially identical to the diameter of the said lower opening 48.

The axial positioning of the central metering body 68 in the lower opening 48 of the hopper 18 delimits, in the hopper 18, an annular passage opening. The section of this annular passage opening is determined by the transverse section of the central metering body 68 at the level of this lower opening 48. When the central metering body 68, represented in FIG. 1, is moved upwards through the lower opening 48, the passage section in the lower opening 48 increases from a minimum value towards a maximum value, which corresponds to the passage section entirely freed by the central metering body.

The devices represented in FIGS. 1 and 2 can be distinguished from one another solely by the different drive mechanisms for the bell 66 and the central metering body 68.

In FIG. 1, the bell 66 is equipped at its upper end with a sleeve 82 which is extended axially upwards beyond the hopper 18. An axial sealing device 84, for example a device of the packing gland type, provides the axial guidance and sealing of the sleeve 82 through an upper wall of the hopper 18. Two hydraulic cylinders 86 and 88 are connected between arms 90 and 92 secured to the upper end of the sleeve 82, and the hopper 18. These hydraulic cylinders 86 and 88 must be dimensioned to provide the necessary force making it possible to raise the bell 66 through the material 20. A third hydraulic cylinder 94 is mounted in leaktight fashion on the upper end of the sleeve 82. Its rod 96 penetrates axially into the sleeve 82 where it is connected to the upper end of the rod 80 of the central metering body 68. This rod 80 is guided inside the sleeve 82 when it is moved vertically with respect to the hopper 18. A controller 100 makes sure that a movement with a travel (c) of the hydraulic cylinders 86 and 88 in one direction, brings about a synchronous movement with a travel (c) of the hydraulic cylinder 94 in the opposition direction. The controller 100 consequently makes it possible to keep the central metering body 68 immobile with respect to the hopper 18 when the bell 66 is raised or lowered by the hydraulic cylinders 86 and 88.

In FIG. 2 the bell 66 is equipped at its upper end with a sleeve 102, which is engaged axially on a fixed sleeve 104. The fixed sleeve 104 is coaxial with the axis 12 and is fixed to an upper wall of the hopper 18. Two hydraulic cylinders 106 and 108 are mounted on this upper wall, and their respective hydraulic cylinder rod 110, 112 penetrates into the hopper 18, where it is connected to the upper end of the sleeve 102. The hydraulic cylinders 106 and 108 must be dimensioned to provide the necessary force making it possible to raise the bell 66 through the material 20. A third hydraulic cylinder 114 is mounted on the upper wall of the hopper 18, so that it penetrates with its hydraulic cylinder rod 116 axially into the fixed sleeve 104 where it is connected to the rod 80 of the central metering body 68. This rod 80 is guided axially inside the fixed sleeve 104 when it moves vertically with respect to the hopper 18. A cylindrical cage 118 surrounds the hydraulic cylinder rods 110 and 112 in order to protect them against soiling and wear by the charging material.

The operation of discharging the hopper, equipped with the member for retaining and for regulating the material, and with the lower sealing member which are described above, will be studied with the aid of FIGS. 3, 4 and 5.

Figure 3:
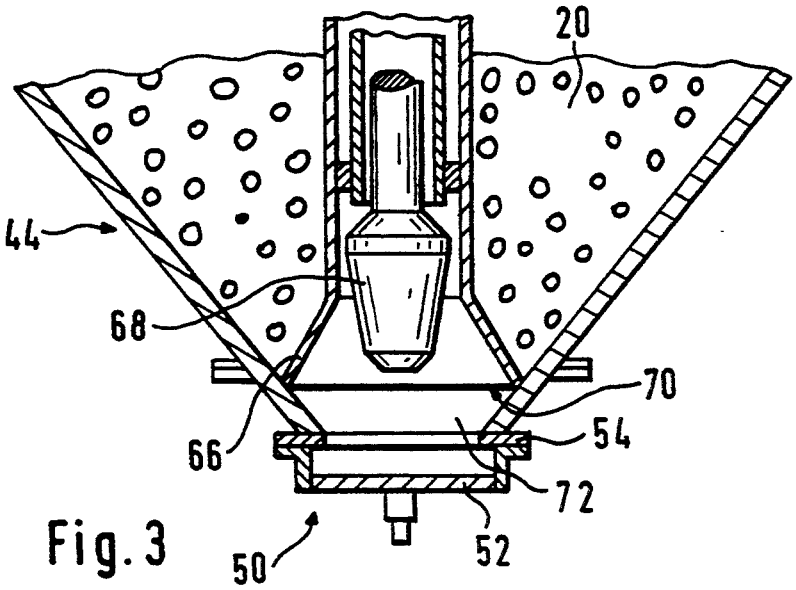
FIGS. 3 to 5 show in diagramatic (vertical) elevation view, the sequential operation of the device of FIG. 2.

In FIG. 3, the lower sealing member 50 is closed, that is to say that the shutter 52 is applied in leaktight fashion against its seat 54. The bell 66 is entirely lowered into its closing off position, in which it closes off the discharge opening 72 and retains the charging material upstream of the sealing member 50. The central metering body 68 is raised up inside the bell 66 and is in a maximum raised position.

Figure 4:
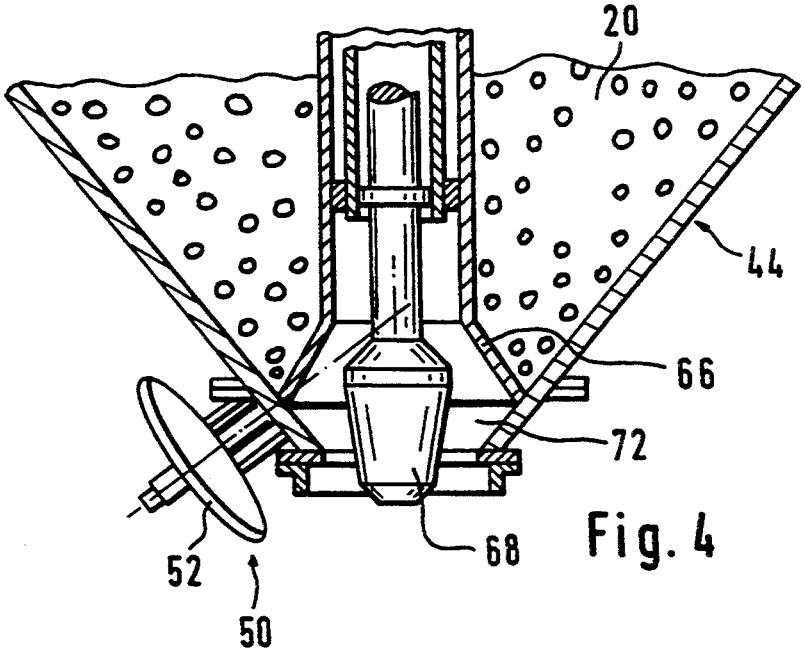

In FIG. 4 the lower sealing member 50 is open, that is to say that the shutter 52 has been pivoted into its protected lateral position. The bell 66 is still entirely lowered into its closing off position and retains the charging material 20 in the hopper 18. The central metering body 68 has been lowered into a position which corresponds to the desired flow rate. In other words, the travel C of the central metering body, that is to say the distance with respect to its maximum raised position, is chosen taking into account the characteristic Q=f (C) valid for the charging material 20 contained in the hopper 18. The device is now prepared for discharging the charging material 20.

Figure 5:
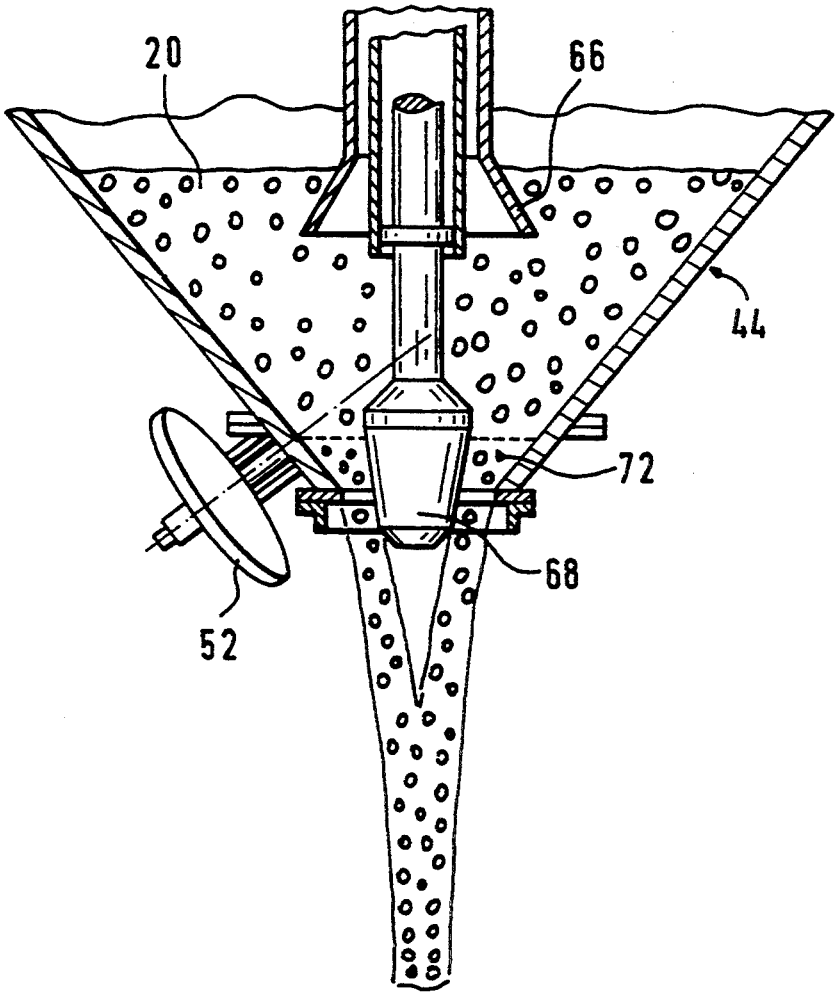

In FIG. 5, the bell 66 is in its raised position in which it frees the discharge opening 72. Its position in the material 20 will be chosen so as to have a minimal influence over the flow rate of material flowing out through the discharge opening 72 and a maximal influence over the homogeneity of the emptying of the hopper 18. The travel of the bell will consequently be determined as a function of the grain size and of the nature of the charging material. It can be adjusted as a function of the charging level in the hopper 18, which naturally drops during the emptying of the hopper 18. This adjustment will, for example, be made automatically as a function of an output signal from a device for continuously weighing the hopper 18.

Figure 6:
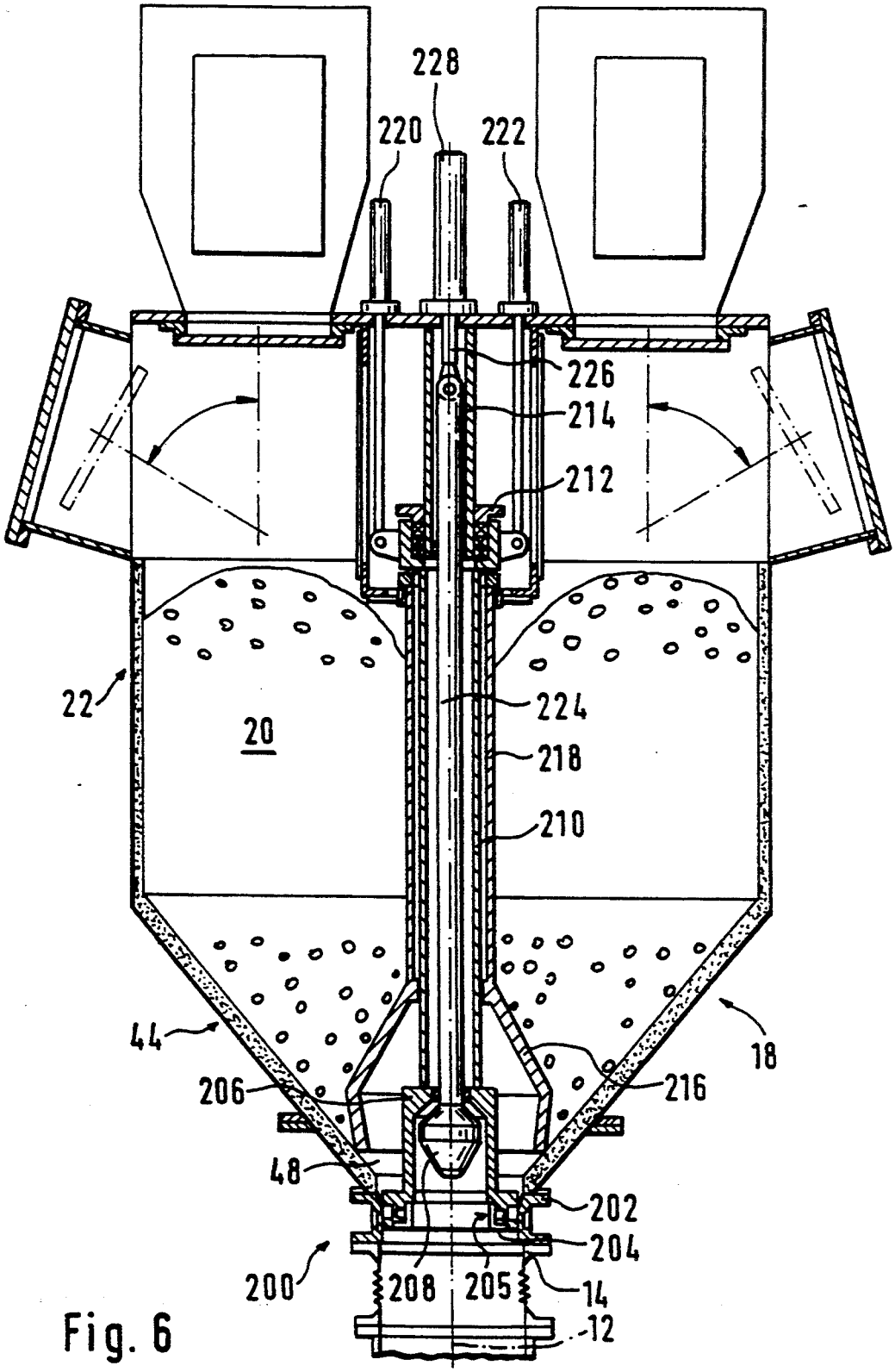
FIG. 6 is a second preferred embodiment, shown in diagramatic elevation (vertical) view of the device of FIG. 1.

FIG. 6 shows an alternate preferred embodiment of the device of FIGS. 1 and 2. As a replacement for a sealing member 50 which was equipped with a pivotable shutter 52 installed below the hopper 18, the device of FIG. 6 comprises a lower sealing member 200 which is completely incorporated into the hopper 18. This member 200 comprises a seat 202 which is mounted in leaktight fashion on the hopper 18 at the level of the lower opening 48, and a closing off element 204 which has the shape of a ring.

The closing off member 204 in the shape of a ring is fixed in leaktight fashion to the lower end of a sleeve 206 back into which a central metering member 208, equivalent to the metering member 68 of FIG. 1 or 2, may be drawn. At its upper end the sleeve 206 is extended by a tube 210 which is engaged in leaktight fashion, for example with the aid of a packing gland 212, on a fixed sleeve 214. The fixed sleeve 214 is fixed onto the hopper 18 so that it can be coaxial with the axis 12. The inside of the sleeve 206, of the tube 210 and of the fixed sleeve 214 are consequently situated, from the pressure point of view, on the blast furnace side.

A bell 216, which corresponds to the bell 66 of FIG. 1 or 2, constitutes a member for retaining the material upstream of the sealing member 200. It will be noted that the tube 210 can slide in a sheath 218, coaxial with the axis 12 and fixed to the upper end of the bell 216.

Two hydraulic cylinders 220 and 222 are connected between the tube 210 and the hopper 18. A control rod 224 axially extends the central metering member 208 through the tube 210 in the fixed sleeve 214, where it is connected to a piston rod 226 of a hydraulic cylinder 228, which is mounted axially on the hopper 18. It is the hydraulic cylinders 220 and 222 which make it possible to raise the bell 216 through the material 20. Indeed, when the tube 210 is raised by the hydraulic cylinders 220 and 222, the bell 216 firstly remains immobile, and the closing off element 204 is drawn back into the bell 216. At the moment at which the upper end of the sleeve 206 bears on the bell 216, the bell 216 is raised from its seat in order to be raised up by the tube 210, together with the closing off element 204.

Figure 7:
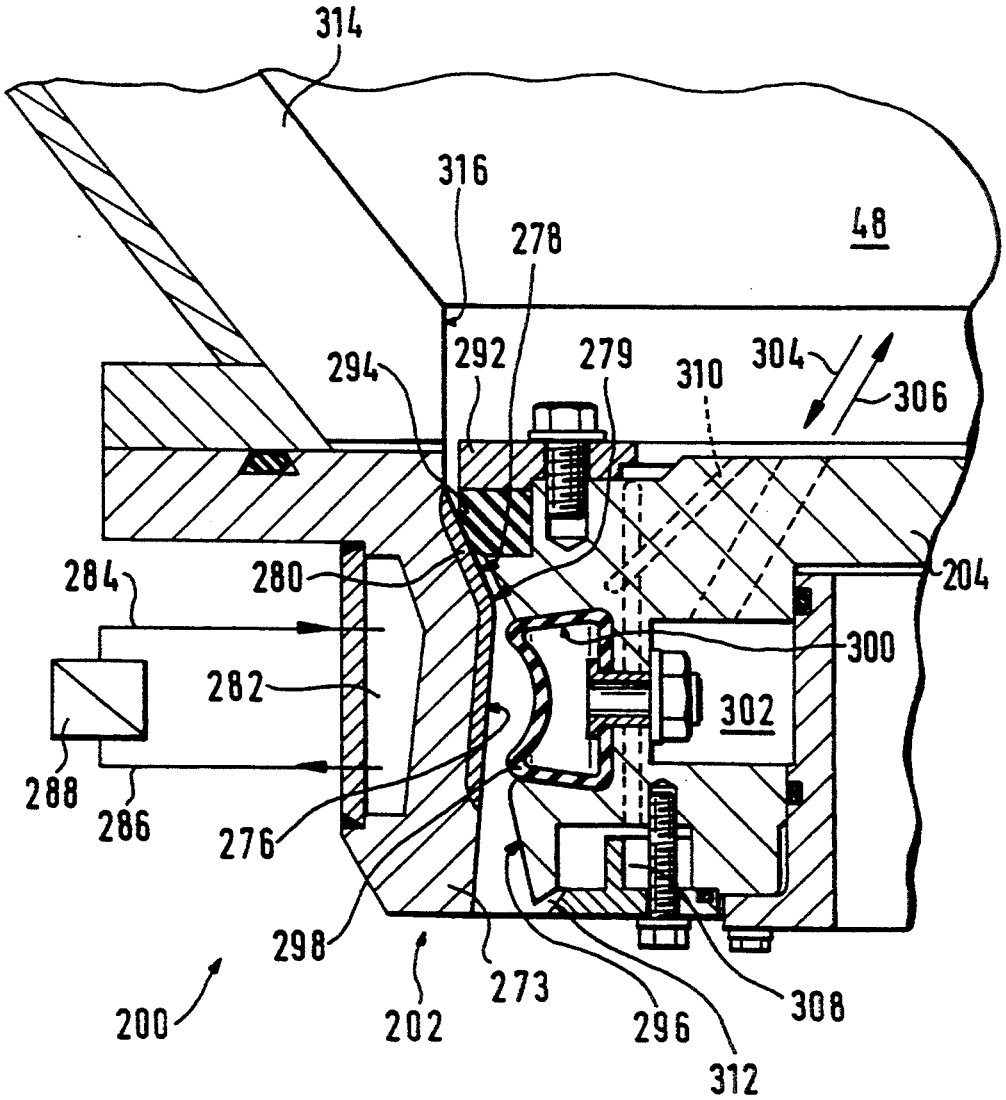
FIG. 7 is a cross-sectional elevation view showing in detail the sealing device of FIG. 6.

FIG. 7 represents embodiment details of the seat 202 and of the closing off element 204. The seat 202 has the form of a sleeve 273 which is coaxial with the axis 12. On the inside, this sleeve 273 is equipped with a first sealing surface 276 and with a second sealing surface 278. The first sealing surface 276 describes an axisymmetric cone frustum which is coaxial with the vertical axis 12 of the device and which flares out slightly in the direction of outflow of the material. The second sealing surface 278, which is situated upstream of the first sealing surface 276, describes an axisymmetric cone frustum which is coaxial with the vertical axis 12 of the device and which flares out towards the inside of the hopper 18. At their intersection, the two surfaces define a restriction neck 279. The two sealing surfaces 276, 278 are preferably coated with an anti-abrasive and anti-corrosive coating 280. On the outside the sleeve 273 is equipped with an annular passage 282 which surrounds the two sealing surfaces 276 and 278. This passage 282 is equipped with outward and return connection ducts for a liquid. These ducts are represented diagrammatically by the arrows 284 and 286 in FIG. 7. The reference 288 diagrammatically represents a unit for treating a liquid, which unit makes sure that the temperature of the liquid circulating in the annular passage 282 is such that the surface temperature of the sealing surfaces 276 and 278 is never below the dew point, in order to prevent condensation, and never above a limiting upper temperature determined, for example, by the limiting working temperature of a seal applied against one of the two surfaces 276 and 278.

In FIG. 7, the closing off element 204 is depicted in an operational position. The closing off element 204 is, in this position, applied with an upper peripheral edge 292, which is equipped with an elastomeric seal 294, against the second leaktight surface 278 of the seat 202. The peripheral edge 292 could, however, also be applied directly against the second leaktight surface 278, thereby providing a metal-to-metal seal. In this case, it will preferably have the form of a spherical ring. From this upper peripheral edge 292, the closing off element 204, which is laterally delimited by a lower peripheral surface 296, decreases in transverse section so that it can penetrate axially through the restriction neck 279 into the space surrounded by the first sealing surface 276.

An inflatable elastomeric seal 298 is housed in an annular cavity 300 which is set out in the lower peripheral surface 296. In the operational position, this inflatable seal 298 faces the first sealing surface 276. When it is deflated, the seal 298 is set back with respect to the lower peripheral surface 296 (cf. FIG. 2). When it is inflated, that is to say pressurized by a fluid, the seal 298 is, in contrast, firmly applied to the first sealing surface 276 and thus provides the sealing between the closing off element 204 and the seat 202. An annular passage 302, which is set out in the closing off element 204, feeds the inflatable seal 298 with a pressurizing fluid. This feed passage 302 is preferably equipped with outward and return connection ducts, represented diagrammatically by the arrows 304 and 306. In this way, a circulation of a cooling liquid can be organized through the inflatable seal 298. This liquid may, moreover, be identical to the liquid circulated through the annular passage 282 of the seat.

In a lower peripheral edge of the closing off element 204, there is set out an annular passage 308 which is connected by a passageway 310 to a compressed air or pressurized gas circuit. This annular passage 308 feeds an annular orifice 312, which points obliquely downwards. When the closing off element 204 is lowered into its seat 202, the air blown through this annular orifice 312 cleans the second, then the first sealing surface from the top downwards.

It will be noted that the inner wall of the hopper 18 consists of a wear coating 314, with a slope of approximately 50° to 60°. This slope is interrupted by a vertical cylindrical surface 316, vertically above the second sealing surface 278, which decreases the wear on this surface.

It will be noted that in the device of FIG. 6, the three members, namely member 216 for retaining the material, member 208 for regulating the flow rate of the material, and the lower sealing member 200 are all incorporated into the hopper 18. This feature makes it possible to connect the lower outlet opening 48 of the hopper 18 directly to the charging pipe 14, without passing through an intermediate leaktight chamber of the type of the chamber 58 of FIG. 1. This results in an appreciable saving in assembly height.

While preferred embodiments have been shown and described, various modifications and substitutions may be made thereto without departing from the spirit and scope of the invention. Accordingly, it is to be understood that the present invention has been described by way of illustrations and not limitations.

What is claimed is:

1. A charging device for feeding an enclosure with a predetermined flow rate of a solid material, comprising:

a hopper including a funnel-shaped lower part which defines a substantially vertical central outflow axis through a central discharge opening of the hopper;

a pipe for feeding the enclosure, which is positioned axially below said lower part of the hopper;

a bell located inside said hopper for closing off said discharge opening in the hopper;

driving means operatively connected to said bell, for moving said bell between a lower position, wherein said bell closes off said discharge opening, and an upper raised position, wherein said bell is substantially neutral to a flow rate flowing through said discharge opening; and a central metering body which is oblong and distinctly more slender than said bell, said central metering body being movable relative to said bell along said central outflow axis so as to penetrate to a greater or lesser degree through said discharge opening in the direction of the feed pipe; and adjusting means operatively connected to said central metering body for adjusting its penetration through said discharge opening in the direction of the feed pipe when said bell is in said upper raised position.

2. The device of claim 1 including:

a control rod attached to said central metering body and coaxial to said vertical central outflow axis, wherein said central metering body comprises:

a lower end frustum which flares out upwardly, and at its widest diameter is connected to an upper end frustum which tapers in the opposite direction and in the direction of said control rod.

3. The device of claim 1 wherein said bell includes a cavity capable of entirely receiving the central metering body, said adjusting means being capable of pulling said central metering body inside said cavity when said bell is in said lower position.

4. The device of claim 3 further comprising a lower sealing member including:

a seat mounted below said hopper, said seat having a sealing surface which points downwards; and a pivotable shutter operatively associated with said seat.

5. The device of claim 1 wherein:

said bell includes a sleeve which is extended upwards axially through said hopper; and said central metering body includes a control rod guided axially in said sleeve.

6. The device of claim 5 wherein:

at least one first hydraulic cylinder is connected between said sleeve and said hopper; and at least one second hydraulic cylinder is connected between said sleeve and said control rod.

7. The device of claim 1 wherein:

said hopper includes a fixed guide sleeve which extends axially downwards inside said hopper;

said bell includes a sleeve which can be engaged on said fixed sleeve;

said central metering body includes a control rod which is guided axially inside said fixed sleeve;

at least a first hydraulic cylinder is connected between said hopper and said sleeve; and at least a second hydraulic cylinder is connected between said hopper and said control rod.

8. The device of claim 1 comprising a lower sealing member including:

a closing off element positioned directly below said bell and axially movable with respect to said latter, said closing off element including:

a lateral peripheral surface;

an inflatable seal incorporated in said lateral peripheral surface;

a central passage opening for said central metering body;

means for moving said closing off element axially between a protected position below said bell and an operational position outside said bell, when the latter is in said lower closing off position; and a seat mounted axially below said discharge opening, said seat including a first sealing surface which points downwards and which surrounds said inflatable seal when said closing off element is situated in said operational position.

* * * * *